US005911463A

United States Patent [19]

Fesko

[11] Patent Number: 5,911,463

[45] Date of Patent: Jun. 15, 1999

[54] LEAF AND YARD DEBRIS RECEPTACLE

[76] Inventor: Michael S. Fesko, 6209 Olive Ave., Sarasota, Fla. 34231

[21] Appl. No.: 08/872,021

[22] Filed: Jun. 10, 1997

[51] Int. Cl.[6] ..... B65D 37/00

[52] U.S. Cl. ..... 294/152; 294/1.1

[58] Field of Search ..... 294/1.1, 1.3, 77, 294/138, 149, 152, 156; 15/257.1; 141/316, 390, 391; 150/107; 190/103, 115; 383/2, 4, 6, 10, 16, 105

[56] References Cited

U.S. PATENT DOCUMENTS

| | | | |
|---|---|---|---|
| 340,303 | 4/1886 | Fransson | 294/152 |
| 954,840 | 4/1910 | Wiedemann | 294/152 X |
| 1,373,136 | 3/1921 | Kranz | 294/152 X |
| 1,559,046 | 10/1925 | McLeran | 294/152 |
| 3,312,263 | 4/1967 | Wahlstrom | 294/1.1 X |
| 3,404,819 | 10/1968 | Rolph | 294/1.1 X |
| 3,747,653 | 7/1973 | Ringer . | |
| 3,792,806 | 2/1974 | Layton | 294/152 |
| 4,006,928 | 2/1977 | Beugin . | |
| 4,519,183 | 5/1985 | Parody | 294/156 X |
| 4,561,480 | 12/1985 | Underwood et al. . | |
| 4,798,572 | 1/1989 | Lafleur et al. . | |
| 4,854,003 | 8/1989 | Roberts . | |
| 4,861,170 | 8/1989 | Patriksson . | |
| 4,958,759 | 9/1990 | Jarvis | 294/138 X |
| 5,251,945 | 10/1993 | Stoops | 294/152 |
| 5,364,188 | 11/1994 | Godfried et al. . | |
| 5,378,220 | 1/1995 | Bunn . | |
| 5,449,083 | 9/1995 | Dougherty et al. . | |
| 5,451,107 | 9/1995 | Ricker . | |

FOREIGN PATENT DOCUMENTS

| | | | |
|---|---|---|---|
| 960634 | 6/1964 | United Kingdom | 294/149 |

*Primary Examiner*—Johnny D. Cherry
*Attorney, Agent, or Firm*—Charles J. Prescott

[57] ABSTRACT

A reusable leaf and yard debris receptacle for holding, carrying and emptying the yard debris such as leaves, grass, branches and longer limbs, palm fronds and the like. The receptacle is flexible for ease in holding for storage and in being flexibly opened and deployed atop the ground for being filled with debris. When closed, flexible spaced carrying handles attached to each side panel facilitate carrying and easy emptying of the debris contained within the receptacle so as to be acceptable for use in conjunction with utility trash pickup services.

2 Claims, 2 Drawing Sheets

LEAF AND YARD DEBRIS RECEPTACLE

BACKGROUND OF THE INVENTION

1. Scope of Invention

This invention relates generally to devices for the gathering, carrying and disposal of loose material gathered during lawn and yard maintenance, and more particularly to a collapsible, reusable lawn and yard debris receptacle for such purposes.

2. Prior Art

Maintaining yard and lawn areas involves the gathering, bundling or holding, transporting and removal of lawn and yard debris including leaves, grass clippings, branches, longer palm fronds and the like. The entire ongoing procedure involves placing the debris into a receptacle or container suitable for holding or retaining the debris, carrying the debris off for temporary storage and then placing the debris at a collection point where utility trash removal services will pick up and remove the receptacle or bundled portions of debris. However, these utility services will typically leave unbundled yard debris as it is difficult to deal with on a piece-by-piece basis.

One well known and conventional means used for this procedure is the utilization of large flexible plastic disposable trash bags or the more rigid reusable plastic or metal garbage containers. Both of these receptacle forms are acceptable for utility trash removal services. However, disposable plastic trash bags are very difficult to fill with yard and lawn debris, especially twigs, branches, longer palm fronds and other objects which can poke through or stick out of the thin plastic bag material. Utilization of the rigid trash can collectors of either metal or plastic are also difficult to use in that the longer pieces of branches and palm fronds will not fit into these containers and must either be mulched, cut or otherwise reduced in size to fit before being placed into such containers.

A number of prior art devices are known to applicant which are intended to in some ways fill this need in lawn and yard maintenance care as follows:

| | |
|---|---|
| Patriksson | 4,861,170 |
| Bunn | 5,378,220 |
| Dougherty et al. | 5,449,083 |
| Beugin | 4,006,928 |
| Underwood et al. | 4,561,480 |
| LaFleur et al. | 4,798,572 |
| Roberts | 4,854,003 |
| Ricker | 5,451,107 |
| Ringer | 3,747,653 |
| Godfried et al. | 5,364,188 |

Of more applicability to the present invention, Dougherty, in U.S. Pat. No. 5,449,083 teaches a reusable and collapsible garden container for collecting and transporting loose debris. However, this invention requires rigid edge members for its deployment and use which limits storablity and would certainly appear to be unacceptable for utility trash pick up services. Likewise, the lawn bag caddy disclosed in U.S. Pat. No. 4,066,928 by Beugin also includes rigid frame support members which limits storability and would likely be unacceptable for utility trash pick up services as such rigid frame members would certainly be damaged by the abusive manner in which such containers are emptied.

The leaf caddy disclosed by Underwood in U.S. Pat. No. 4,561,480 would appear to be suited for that limited purpose only, but larger pieces of yard debris and the storage of such debris would be difficult at best with this device. Further, utility trash pick up services would find this container to be unacceptable for trash pick up and removal.

The "superman" costume cleverly disguised as a flexible receptacle for collecting and transporting loose debris invented by Roberts and disclosed in U.S. Pat. No. 4,854,003 would appear to be quite limiting in its alleged use in collecting lawn and yard debris. The user is likely to find himself becoming part of the debris contents in this device.

The invention by Ricker in U.S. Pat. No. 5,451,107 is generally similar to the leaf caddie in the above-discussed '480 patent with similar limitations for use. The receptacle for lawn debris invented by Ringer in U.S. Pat. No. 3,747,653 also includes rigid frame members which interact to hold the open end of this device in an in-use position, requiring one hand of the user to accomplish this procedure while attempting one handedly to force leaves into the open end thereof. The corner gathered lawn and leaf bag in U.S. Pat. No. 5,364,188 invented by Godfried is presumed to be disposable in its best form and would appear to be acceptable for utility trash pick up, but would be difficult to manipulate and store when full of lawn and yard debris.

The present invention provides a flexible, easily storable and reusable yard and lawn debris receptacle which may easily be deployed into a position atop the ground to be filled with all forms and sizes of lawn debris, including longer branches and palm fronds. The device is easily closeable, allowing longer pieces of debris to extend from each partially open end thereof, may easily be carried to a place of storage or into position for utility trash pick up and then, by providing dual spaced handles on each side of the device, emptying into a trash pick up vehicle is facilitated to increase its acceptability for this purpose.

BRIEF SUMMARY OF THE INVENTION

This invention is directed to a reusable leaf and yard debris receptacle for holding, carrying and emptying the yard debris such as leaves, grass, branches and longer limbs, palm fronds and the like. The receptacle is flexible for ease in holding for storage and in being flexibly opened and deployed atop the ground for being filled with debris. When closed, flexible spaced carrying handles attached to each side panel facilitate carrying and easy emptying of the debris contained within the receptacle so as to be acceptable for use in conjunction with utility trash pickup services.

It is therefore an object of this invention to provide a lawn and yard debris receptacle which is flexible for easy storage and for expanding deployment during the gathering of large quantities of debris.

It is still another object of this invention to provide a lawn and yard debris receptacle which is easily deployable atop the ground for containing large quantities of debris, including longer pieces of such debris which may extend from the partially open ends of the receptacle when closed.

It is yet another object of this invention to provide a lawn and yard debris receptacle which is easily carryable when filled and closed.

It is still another object of this invention to provide a lawn and yard debris receptacle with an expandable bottom panel for increased volume capacity.

Another object of this invention is to provide a lawn and yard debris receptacle which is reusable and acceptable for use in utility trash pick up services.

Still another object of this invention to provide a lawn and yard debris receptacle which is easily and somewhat automatically emptyable when held by two spaced flexible handles on one side of the receptacle.

In accordance with these and other objects which will become apparent hereinafter, the instant invention will now be described with reference to the accompanying drawings.

DETAILED DESCRIPTION OF THE INVENTION

Figure 1:
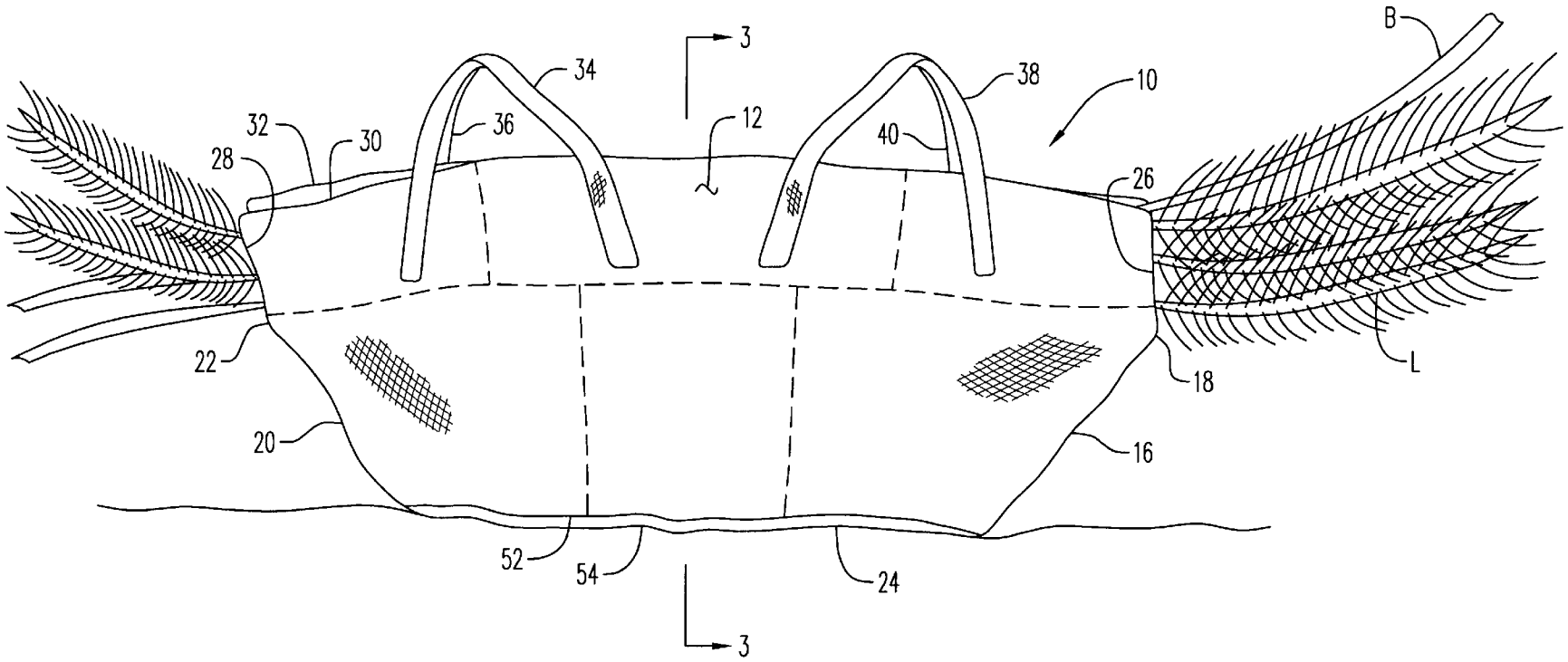
FIG. 1 is a side elevation view of the invention in its filled and closed configuration.

Referring now to the drawings, the invention is shown generally at numeral 10. The receptacle 10 is fabricated of two large side panels 12 and 14 which are generally elongated in nature and formed of flexible, durable, nylon fabric material connected as described below by using double stitch overlay seam construction.

The flexible side panels 12 and 14 are connected together along end margins 16 and 20 which connection terminates at 18 and 22, respectively. The upper or top margins 30 and 32 are unconnected and hemmed or doubled over as are end margin portions 26 and 28.

Figure 3:
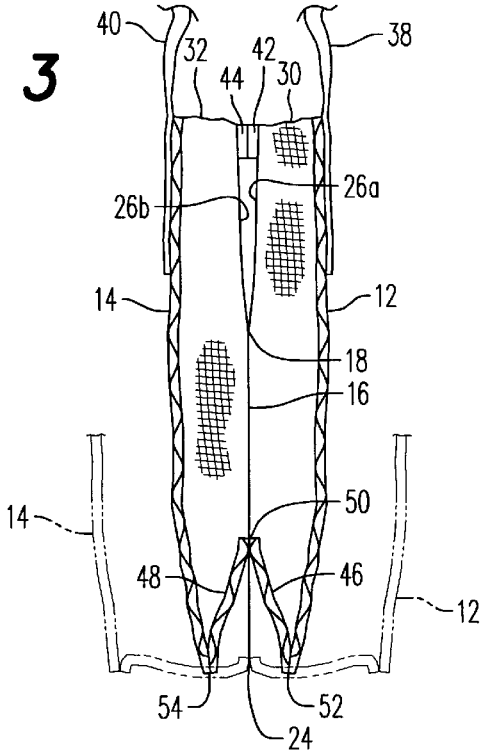
FIG. 3 is a section view of arrows 3—3 in FIG. 1 and showing the expandable bottom panel in phantom.

The bottom margins 52 and 54 of the side panels 12 and 14 are connected to elongated expandable panels 46 and 48 to form an expandable bottom 24 as best seen in FIG. 3. The elongated expanding panels 46 and 48 are sewn together along inwardly disposed common margin 50 to form an expandable pleat arrangement for increasing the overall capacity of the receptacle 10.

Figure 2:
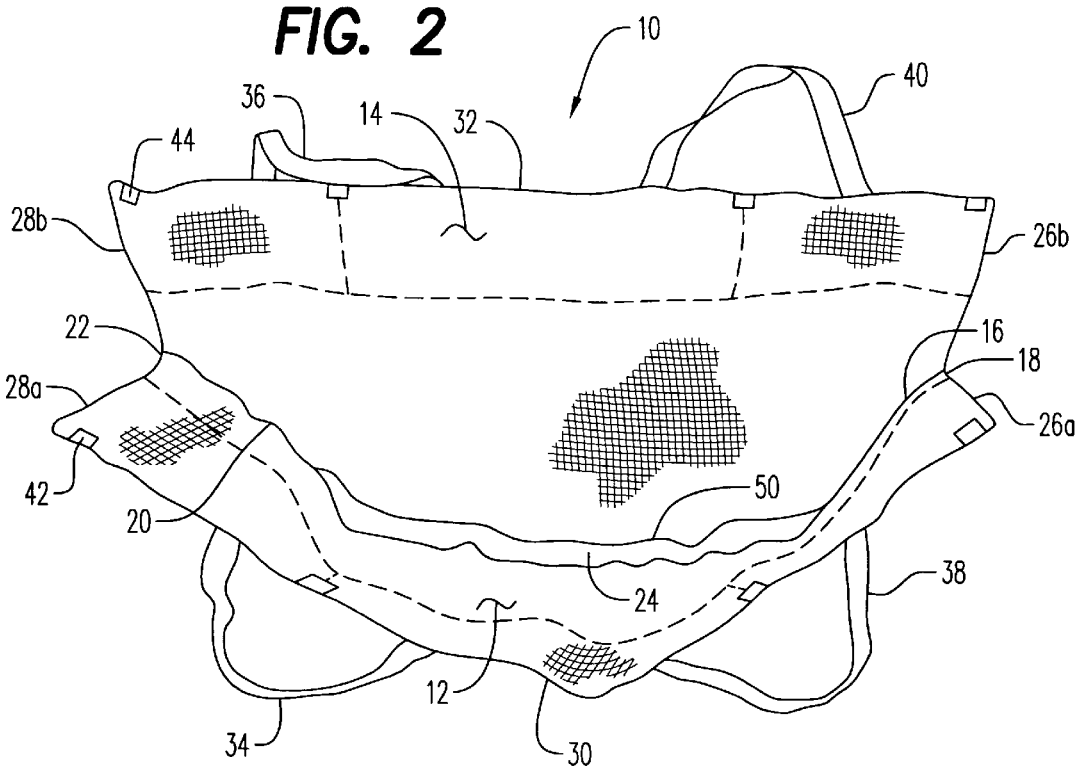
FIG. 2 is a side perspective view of the invention in its expanded, open position as when being either deployed atop the ground or being emptied of debris.

The top margins 30 and 32 of the side panels 12 and 14, respectively are openable as seen in FIG. 2 and are releasibly closeable as seen in FIGS. 1 and 3 by mating patches of two part hook and loop material (VELCRO) 42 and 44. In the preferred embodiment four (4) such two part hook and loop material patches 42 and 44 are provided along the inner top margin surfaces as best seen in FIG. 2.

When in a closed configuration as seen in FIGS. 1 and 3, end openings 26 and 28 formed by unconnected end margin portions 26*a*/26*b* and 28*a*/28*b*, respectively, are provided so that longer pieces of lawn and yard debris shown at L and B in FIG. 1 such as palm fronds, tree branches, banana leaves and the like may extend out through one or both of these end openings 26 and 28 without the need for shortening these pieces of debris prior to disposal.

Four carrying handles 34, 36, 38 and 40 are provided. Each of these handles 34, 36, 38 and 40 is formed of flexible strap material and attached at each end by sewing on to the corresponding side panels 12 and 14 as shown. By this arrangement, two separate combinations of pairs of handles are provided for the various functions of the receptacle 10. Handle pairs 34/36 and 38/40 are provided as seen in FIG. 1 for carrying the filled and closed receptacle 10 as shown. This arrangement significantly improves the carrying ability of the heavy debris bundle in that both hands of the user are balanced and in a level position directly in front of the user to reduce body strain.

In FIG. 2, handle pairs 36 and 40 may be grasped so as to both facilitate deployment of the empty receptacle 10 atop the ground for filling and also to facilitate emptying of the contents of the previously filled receptacle 10. Although two part hook and loop portions 42/44 retain the closed configuration of the receptacle 10, a brisk jerk of upward movement following slight downward movement while holding handles 36 and 40 (or handles 34 and 38 if the receptacle is reversed) which are disposed on one side of panel 14 will easily disengage these two part connectors 42/44 by the inertia force exerted by the debris contents. By this arrangement, utility trash pick up employees should encounter no difficulty in emptying the contents of the receptacle 10 without the need for undue manipulation or disengagement. This feature significantly facilitates the use of the invention 10 in lieu of the disposable plastic trash bags or reusable rigid plastic or metal trash containers.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A leaf and yard debris receptacle comprising:

a pair of elongated flexible side panels each having spaced top and bottom margins and end margins;

said bottom margins aligned and connected together to form a bottom, said top margins being separable to open said receptacle and including means for releasably attaching said top margins together to close and to contain the debris within said receptacle;

said end margins aligned and connected together along a portion of a length thereof which extends from a corresponding end of said bottom margins toward but not to a corresponding end of said top margins to define elongated end openings whereby said receptacle will more fully open when spreading said top margins and said end openings apart and whereby longer pieces of debris may extend from within said receptacle out through said end openings when said receptacle is closed;

a pair of flexible spaced apart handles attached to, and extending from said top margin of, each said side panel for carrying and emptying said receptacle;

said bottom including an expandable pleat connected to and extending centrally a length of said bottom, said pleat expanding as said receptacle is filled with leaf and yard debris to increase the debris holding capacity of said receptacle.

2. A reusable leaf and yard debris receptacle for holding and securing such debris and also serving as a trash pickup receptacle whereby utility trash pickup services accept, empty the debris and return said receptacle when emptied, said receptacle comprising:

two elongated, generally coextensive flexible side panels connected along common bottom margins and a lower portion of common end margins, an upper portion of said common end margins being unconnected to define elongated end openings at each end of said receptacle, common top margins of said side panels being unconnected and including two-part hook and loop means for releasably attaching said top margins together to close and to retain the debris within said receptacle;

said bottom margins having a length thereof shorter than a length of said top margins, said end margins extending diagonally inward toward said bottom margins from said end openings:

said end openings allowing said side panels to be further spread apart while filling said receptacle with the debris and for permitting longer pieces of the debris to extend from said end openings when said receptacle is closed;

two spaced flexible handles connected to, and extending from said top margin of each said side panel for manually manipulating said receptacle into an open, deployed position for filling with the debris, for carrying the receptacle when filled with the debris when closed by attachment of said two-part hook and loop means together, and for emptying said receptacle of the yard debris after said hook and loop means is unattached;

a flexible elongated expansion pleat connected to and extending centrally between said bottom margins, said bottom margins and said pleat configured to expand and increase the debris holding capacity of said receptacle.

* * * * *

UNITED STATES PATENT AND TRADEMARK OFFICE

CERTIFICATE OF CORRECTION

PATENT NO. : 5,911,463

DATED : June 15, 1999

INVENTOR(S) : Michael S. Fesko

It is certified that error appears in the above-indentified patent and that said Letters Patent is hereby corrected as shown below:

Column 4, line 46, after "centrally", insert -- along --.

Signed and Sealed this

Second Day of November, 1999

*Attest:*

Q. TODD DICKINSON

*Attesting Officer*

*Acting Commissioner of Patents and Trademarks*